US005591929A

United States Patent [19]

Wellman

[11] Patent Number: 5,591,929

[45] Date of Patent: Jan. 7, 1997

[54] QUAD BASS DRUM PEDAL AND METHODS OF CONSTRUCTING AND UTILIZING SAME

[76] Inventor: Ronald J. Wellman, 816 Cawood, Lansing, Mich. 48915

[21] Appl. No.: 242,328

[22] Filed: May 13, 1994

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS

| | | | |
|---|---|---|---|
| 3,563,129 | 2/1971 | Cantrell | 84/422.1 |
| 3,618,441 | 11/1971 | Fearns | 84/422.1 |
| 3,968,718 | 7/1976 | Carver | 84/422.1 |
| 4,188,853 | 2/1980 | Bills | 84/422.1 |
| 4,538,499 | 9/1985 | Livingston | 84/422.1 |
| 4,782,733 | 11/1988 | Herring | 84/422.1 |
| 4,945,803 | 8/1990 | Norwood | 84/422.1 |
| 5,204,485 | 4/1993 | Lombardi | 84/422.1 |

*Primary Examiner*—Cassandra C. Spyrou
*Attorney, Agent, or Firm*—Weiner, Carrier & Burt, P.C.; William F. Esser; Irving M. Weiner

[57] ABSTRACT

A device for beating drums selectively by either foot. A first foot mechanism controls the movement of a first mallet. A second foot mechanism controls the movement of a second mallet remotely. A third foot mechanism controls the movement of a third mallet. A fourth foot mechanism controls the movement of a fourth mallet remotely. A first support mechanism, adjacent the first and fourth foot mechanisms, elevates a heel portion of a foot. A second support mechanism, adjacent the second the third foot mechanisms, elevates a heel portion of a foot.

23 Claims, 3 Drawing Sheets

QUAD BASS DRUM PEDAL AND METHODS OF CONSTRUCTING AND UTILIZING SAME

BACKGROUND OF THE INVENTION

1. Field of Invention

This invention pertains to a device for improving the operability, efficiency, and comfortability of bass drum pedals, and particularly to a quad bass drum pedal in which either foot selectively controls a plurality of drum beaters, using pedal positions which are programmably adjustable in three dimensions.

2. Description of the Relevant Art

There are known bass drum pedals. For example, Livingston U.S. Pat. No. 4,538,499 discloses a drum beating apparatus having a linkage for beating a drum from a remote foot pedal. Livingston fails to disclose a quad bass drum pedal in which each of the user's foot controls a plurality of drum beating devices, or in which the foot pedals are selectively adjustable in three dimensions.

Herring U.S. Pat. No. 4,782,733 discloses a double drum beater in which a single foot pedal controls two drum beaters which oscillate out of phase relative to each other. Herring fails to disclose a quad bass drum pedal in which either foot controls a drum beater for each of a plurality of remotely-located drums, having means for adjustably positioning the foot pedals relative to each other.

Fearns U.S. Pat. No. 3,618,441 discloses a double acting drum pedal wherein rocking action by a single foot pedal controls the movement of a single drum beater, but fails to disclose a quad drum beater device having coupling means for remotely controlling the drum beater.

Norwood U.S. Pat. No. 4,945,803 discloses a double bass drum pedal apparatus wherein one mallet is controlled by depressing the toe portion of the foot pedal, and a second mallet is controlled by depressing the heel portion of the foot pedal. Norwood fails to provide a quad bass drum beater device having means for remotely controlling the operation of a plurality of drum mallets by a plurality of foot pedals, or having means for adjustably positioning a plurality of foot pedals.

Bills U.S. Pat. No. 4,188,853 discloses a double acting drum pedal wherein a single drum is beaten on both a downward and an upward motion of a single foot pedal. Bills fails to disclose a drum pedal device for beating a plurality of drums, having means for controlling the beating operation from a plurality of foot pedals operated by either foot, or means for adjustably positioning a plurality of foot pedals relative to each other and to the drum beaters.

Engineered Percussion manufactures a double pedal device wherein both a proximally-located and a remotely-located foot pedal controls the beating of a single drum, having means for adjustably positioning the remote foot pedal. The device fails to disclose a quad drum pedal device in which a plurality of drums are selectively beaten using a plurality of foot pedals operated by either foot, each of which controls a drum mallet and includes means for adjustably positioning the user's foot in a comfortable position for improved performance during extended play.

SUMMARY OF THE INVENTION

The present invention overcomes the above-discussed limitations and shortcomings of known drum beating devices, and satisfies a significant need for a quad bass drum beating device having means for remotely coupling a plurality of foot pedals to a plurality of drum beaters, and having means for adjustable placement thereof.

There is provided a quad bass drum pedal in which a plurality of bass drums are capable of being beaten selectively by either foot. A plurality of foot pedals, mallets, and associated controlling mechanisms are provided for each foot, including linkages for remotely controlling a mallet with a foot pedal. In a preferred embodiment, the foot pedals are adjustable relative to the drums and include means for adjustably elevating each foot relative to the pedal for improved comfort during extended play.

Specifically, the present invention includes the combination of a first dual pedal device comprising a first drum mallet, first foot pedal, first controlling means connected therebetween, a second drum mallet, second foot pedal and second controlling means connected to the second foot pedal; a second dual pedal device comprising a third drum mallet, third foot pedal, third controlling means connected between the third mallet and the third foot pedal, a fourth drum mallet, fourth foot pedal, and fourth controlling means connected to the fourth foot pedal; a first remote coupling means connected between the second drum mallet and the fourth controlling means, for remotely controlling the second drum mallet with the fourth foot pedal; and a second remote coupling means connected between the second controlling means and the fourth drum mallet, for remotely controlling the fourth drum mallet utilizing at least one drive belt for facilitating the remote connection.

The present invention additionally includes means, connected to each dual pedal device, for independently adjustably supporting the heel portion of the user's foot at a substantially elevated position relative thereto.

In use, each drum to be played is placed in their desired positions, and each dual pedal device is positioned accordingly by arranging each dual pedal device adjacent to its corresponding drum, using the universal joints associated with both remote coupling means. Next, the heel supports for each dual pedal device is adjusted to position the user's foot in a comfortable position when performing. Thereafter, the device can be used to beat the drums, with each foot independently capable of beating each drum.

If, for example, the drum situated to the user's left is beaten by the user, either foot may control such action by depressing either the left foot pedal of the dual pedal device operated by the user's left foot, or by depressing the right foot pedal of the dual pedal device operated by the user's right foot. Similarly, the drum situated to the user's right is beaten either by depressing the left foot pedal of the dual pedal device operated by the user's right foot, or by depressing the right foot pedal of the dual pedal device operated by the user's left foot.

An object of the invention is to provide a quad drum pedal device for selectively controlling a plurality of drums with either foot.

Another object of the invention is to provide a quad pedal device which provides means for selectively remotely controlling a plurality of drums from remotely-located foot pedals.

It is also an object of the invention to provide a quad pedal device having means for comfortably and adjustably supporting the heel portion of the user's foot in an elevated position relative to the foot pedals associated therewith.

Other objects, advantages and salient features of the present invention will become apparent from the following detailed description, which, when taken in conjunction with the annexed drawings, discloses preferred embodiments of the present invention.

DETAILED DESCRIPTION OF THE PREFERRED EMBODIMENTS

Figure 1:
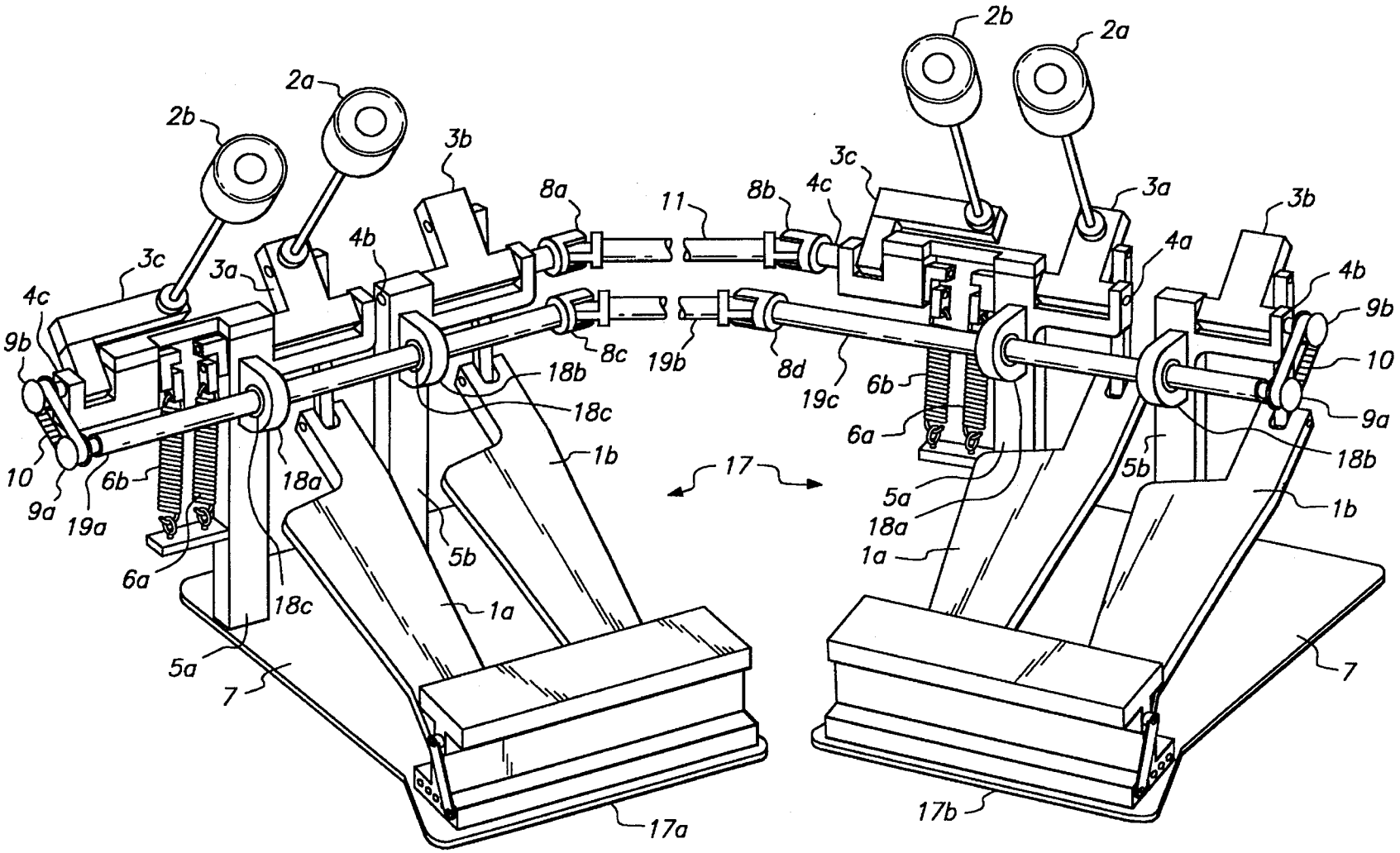
FIG. 1 is a perspective view of a preferred embodiment of the present invention.

Referring to FIG. 1, there is shown a quad drum pedal device according to the present invention. The invention is preferably but not necessarily made substantially of a sturdy yet relatively lightweight material, such as stainless steel or aircraft aluminum, but alternatively the device is made from other materials.

In the preferred embodiment of the present invention, a quad drum pedal device preferably but not necessarily comprises two dual pedal devices 17*a* and 17*b*, and means for coupling them together. Because the device includes two dual drum pedal devices 17*a* and 17*b* which are preferably but not necessarily constructed substantially identically, the description of one dual pedal device set forth hereinbelow applies substantially equally to the other.

Each dual drum pedal device 17*a*, 17*b*, provides the user with the capability of moving a first local mallet 2*a* by a first foot pedal 1*a*, a remote mallet by a second foot pedal 1*b*, and a second local mallet 2*b* by remote means. Referring to FIG. 1, each dual drum pedal device 17*a*, 17*b* preferably but not necessarily comprises two pedals 1*a* and 1*b*; two mallets 2*a* and 2*b*; three mallet supports 3*a*, 3*b* and 3*c*; three mallet axles 4*a*, 4*b*, and 4*c*; two biasing means 6*a* and 6*b*; and a base plate 7.

According to the preferred embodiment of the present invention, pedal 1*a* of each dual pedal device 17*a*, 17*b* preferably operatively moves mallet 2*a*, which is situated substantially adjacent thereto. Specifically, mallet 2*a* and pedal 1*a* are both pivotally connected to a means for moving mallet 2*a* rotationally about a horizontal axis. Such controlling means preferably but not necessarily comprises mallet support 3*a*, to which mallet 2*a* is attached; and mallet axle 4*a*, which is supported by support post 5*a*, adapted to rotate about its longitudinal axis, and attached to mallet support 3*a* along a central region thereof, shown in FIG. 1. In this way, rotating pedal 1*a* relative to base plate 7 causes mallet 2*a* to rotate about an axis defined by mallet axle 4*a* so that mallet 2*a* moves into and out of contact with an adjacent drum.

Mallet axle 4*a* is preferably but not necessarily connected to a means for biasing mallet 2*a* and pedal 1*a* into a position, comprising spring 6*a*. One end of spring 6*a* is preferably but not necessarily attached to support post 5*a*, and a second end thereof is attached to mallet axle 4*a*, so that as mallet 2*a* rotates about axle 4*a* from a first position, spring 6*a* subsequently automatically returns mallet 2*a* thereto. Such position is preferably but not necessarily one in which mallet 2*a* is in position to strike a drum and drum when pedal 1*a* is depressed.

Pedal 1*b* of each dual drum pedal device 17*a*, 17*b* is preferably but not necessarily positioned adjacent to pedal 1*a* thereof, pivotally connected to base plate 7 at its heel portion, and connected to a second means for controllably moving a remotely-situated mallet about an axis, such means comprising a second mallet support 3*b* which is connected to and adapted to rotate about a second mallet axle 4*b*.

Each dual drum pedal device 17*a*, 17*b* includes a second mallet 2*b*, which is attached to a third mallet support 3*c* so as to rotate about a third axis defined by a third axle 4*c*, as shown in FIG. 1. Axle 4*c* preferably but not necessarily connects to a first means for coupling mallet 3*c* to a remotely-situated pedal so that mallet 3*c* is operatively controlled by remote means. A second biasing means 6*b* is preferably but not necessarily connected between axle 4*c* and a support post 5*a* so as to urge mallet 2*b* in a particular position.

As shown in FIG. 1, the first coupling means preferably but not necessarily connects mole 4*b* of dual pedal device 17*a* with axle 4*c* of dual pedal device 17*b*, so that pedal 1*b* of dual pedal device 17*a* remotely controls the movement of mallet 2*b* of dual pedal device 17*b*. Such first coupling means preferably but not necessarily includes drive shaft 11 and universal joints 8*a* and 8*b*, which are situated at either end of drive shaft 11 so that each dual pedal devices 17*a* and 17*b* can adjustably angularly pivot about universal joints 8*a* and 8*b*, respectively.

Axle 4*b* additionally connects to a second means for coupling a remote mallet thereto. The second coupling means preferably but not necessarily connects axle 4*c* of dual pedal device 17*a* with axle 4*b* of dual pedal device 17*b*, wherein such coupling cannot be facilitated entirely by a single drive shaft and a pair of universal joints, due to axles 4*b* and 4*c* being positioned on the outer ends of their respective dual pedal devices 17*a*, 17*b*. Referring to FIG. 1, the second coupling means preferably but not necessarily comprises drive belts 10*a* and 10*b*; drive shafts 19*a*, 19*b*, and 19*c*; drive shaft supports 18*a* and 18*b*; and gearing 9*a* and 9*b*. Each drive shaft support 18*a* and 18*b* preferably but not necessarily extends outwardly from support posts 5*a* and 5*b*, respectively, and includes an aperture defined laterally therethrough so as to support drive shafts 19*a* and 19*c*. Each drive shaft support 18*a*, 18*b* preferably but not necessarily includes a ball-bearing insert 18*c* which is fitted within the aperture of drive shaft support 18*a*, 18*b* so as to provide drive shafts 19*a* and 19*c* with a substantially frictionless movement therein.

In the preferred embodiment, the second coupling means includes universal joints 8*c* and 8*d*, which are positioned adjacent to universal joints 8*a* and 8*b*, respectively, so that the dual pedal devices 17*a* and 17*b*, maintain their adjustability relative to each other as described hereinabove.

Coupling between drive shafts 19*a* and 19*b* and dual pedal devices 17*a* and 17*b*, is preferably but not necessarily accomplished by drive belts 10*a* and 10*b*, and gearing 9*a* and 9*b*. As shown in FIG. 1, gears 9*a* attach to outer ends of drive shafts 19*a* and 19*c*, gears 9*b* attach to mallet axle 4*c*of dual pedal device 17*a* and to mallet axle 4*b* of dual pedal device 17*b*, and drive belts 10*a* and 10*b* are positioned over gears 9*a* and 9*b* so as to engage therewith. As a result, movement by axle 4*b* of dual pedal device 17*b*, causes drive shafts 19*a*, 19*b* and 19*c* to rotate about their longitudinal axes, thereby pivoting mallet 2*b* of dual pedal device 17*a* about axle 4*c*.

The present invention preferably but not necessarily includes a plurality of ball bearing inserts which operatively engage with each axle 4*a*, 4*b*, and 4*c* so as to allow substantially frictionless movement thereof.

The present invention preferably but not necessarily includes means for adjustably supporting the heel portion of the user's feet in an elevated position relative to each base plate 7. Referring to FIGS. 1–4, the heel supporting means preferably but not necessarily includes heel member 12; heel base tubing 14, one end of which attaches to base plate 7 and extends outwardly therefrom; and heel rod 13, which attaches to the lower surface of heel member 12 so as to extend outwardly therefrom, and is selectively adjustably telescopically disposed within base tubing 14. Alternatively, heel rod 13 is formed integrally with heel member 12, and base tubing 14 is formed integrally with base plate 7.

Figures 2, 3, 4:
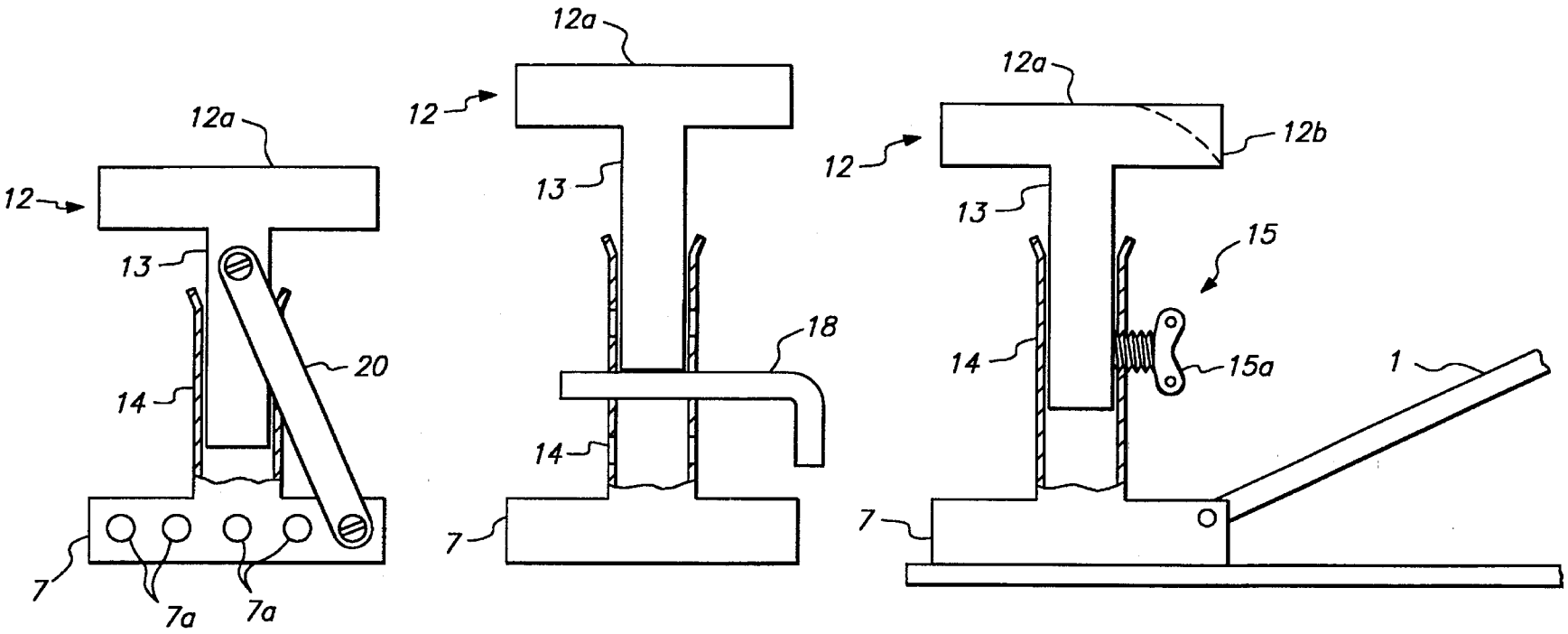
FIG. 2 is a side elevational view of a preferred embodiment of the adjustable heel support of the present invention.
FIG. 3 is a side elevational view of a second embodiment of the adjustable heel support of the present invention.
FIG. 4 is a side elevational view of a third embodiment of the adjustable heel support of the present invention.

Heel member 12 preferably but not necessarily is wide enough to allow the user's foot to comfortably operate both foot pedals 1*a* and 1*b* of dual pedal devices 17*a* and 17*b*, and includes an upper surface 12*a* which is substantially flat (FIGS. 2–4). Alternatively, upper surface 12*a* is shaped to substantially follow the contour of the heel portion of a foot, and may extend beyond the heel portion thereof so as to provide support for an arch portion of the foot. For example, side 12*b* of heel support 12 may be substantially tapered near upper surface 12*a* in order to reduce resistance on the foot when a foot pedal 1*a* or 1*b* is depressed, as shown in the dotted line in FIG. 4. Further, upper surface 12*a* of heel member 12 preferably but not necessarily provides a substantially hardened surface, but alternatively upper surface 12*a* is padded for comfortable extended play.

The heel supporting means of the present invention additionally includes a means for quickly and easily locking heel rod 13 in a fixed position within base tubing 14, preferably but not necessarily comprising bolt 15 having head 15*a* for manual tightening thereof. As shown in FIG. 4, bolt 15 threadingly engages with an internally-threaded aperture located along base tubing 14. Locking rod 13 in a fixed position is accomplished by manually tightening bolt 15 until the second end of bolt 15 makes frictional contact with heel rod 13.

Alternatively, the heel locking means comprises elongated locking member 20, which pivotally attaches at one end to heel rod 13 and selectively engages at the second end with one of a plurality of apertures 7*a* located along base plate 7. In this way, the position of heel support member 12 is placed into an elevated position relative to base plate 7 by positioning the second end of locking member 20 over the desired aperture, which causes heel rod 13 to move within base tubing 14 accordingly, and inserting a bolt or rod through the aperture and the second end of locking member 20, as shown in FIG. 2.

As shown in FIG. 3, the heel support locking means alternatively includes base tubing 14 having a plurality of apertures defined laterally therethrough at spaced relations therealong, and a rod 18 adapted for selective insertion through the base tubing apertures so that heel rod 13 rests thereon.

Figure 5:
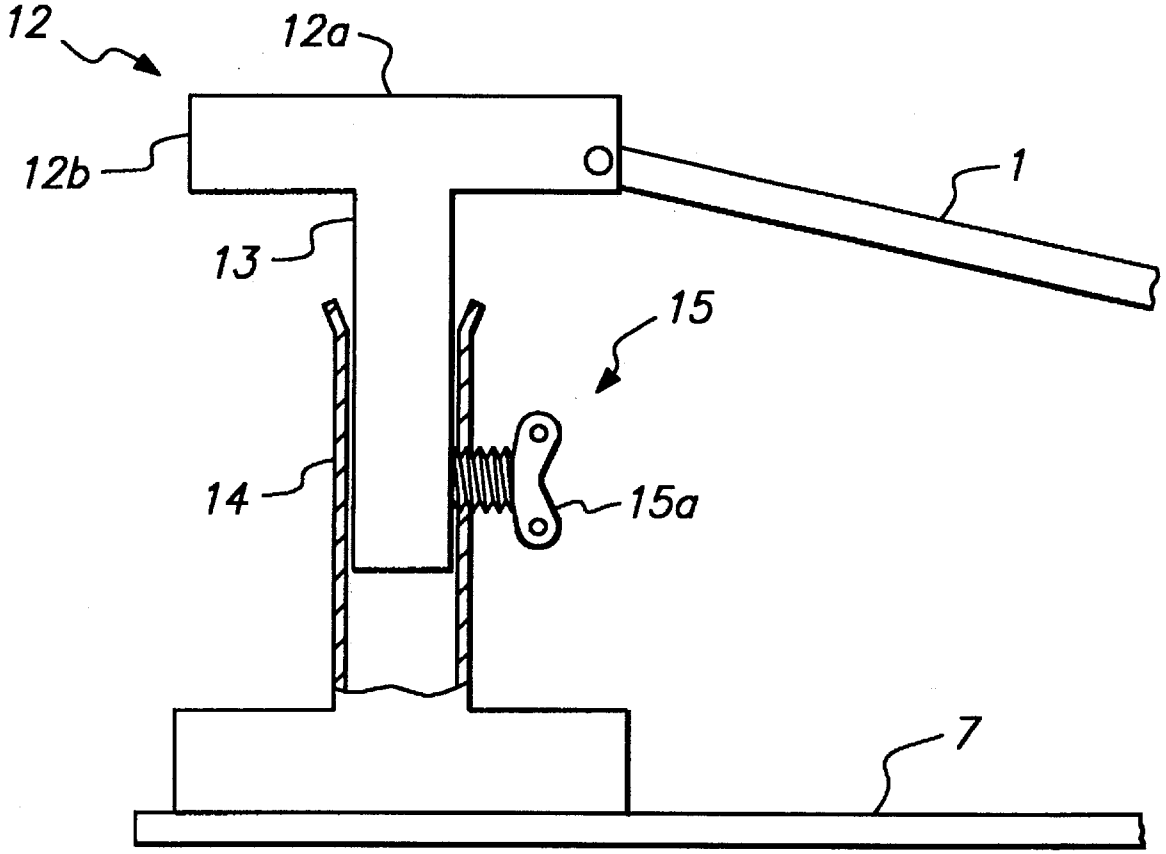
FIG. 5 is a side elevational view of a third embodiment of the adjustable heel support of the present invention showing its connection to a foot pedal.

Although foot pedal 1 is preferably but not necessarily pivotably connected to base plate 7 as shown in FIG. 4, alternatively foot pedal 1 is pivotably connected to heel support member 12 as shown in FIG. 5, or to heel rod 13 (not shown).

In use, each dual pedal device 17*a*, 17*b*, is adjustably positioned relative to the user and/or the drums associated therewith, using universal joints 8*a*, 8*b*, 8*c* and 8*d* of the remote coupling means. Next, the heel supports for both dual pedal devices 17*a* and 17*b*, are adjusted by disengaging the heel support locking means, sliding heel rod 13 substantially within heel tubing 14 until heel support member 12 is positioned at the desired elevation relative to foot pedals 1 and/or base plates 7, and locking heel rod 13 in place. Thereafter, the device can be used to beat either of the two drums selectively using either foot.

For example, the drum situated adjacent to the user's left foot and associated dual pedal device 17*a* may be beaten either by depressing pedal 1*a* thereof, or by depressing pedal 1*b* of dual pedal device 17*b*, using the second remote coupling means. Similarly, the drum situated adjacent to the user's right foot and associated dual pedal device 17*b*, may be beaten either by depressing pedal 1*a* thereof, or by depressing pedal 1*b* of pedal 1*b* of dual pedal device 17*a* using the first remote coupling means.

Although there have been described what is at present considered to be the preferred embodiments of the invention, it will be understood that the invention can be embodied in other specific forms without departing from the spirit or essential characteristics thereof.

By way of example, the adjustable heel support means may cooperate with either single or dual drum pedal devices, wherein the width of heel support member 12 is sized accordingly, depending on the number of drum pedals associated therewith.

The desired embodiments are, therefore, to be considered in all aspects as illustrative, and not restrictive. The scope of the invention is indicated by the appended claims, rather than by the foregoing description.

I claim:

1. A quad bass drum pedal, comprising:

a first dual drum pedal including: a first beater, a first foot pedal, and first means operatively connected to said first beater and said first foot pedal for controlling a substantially rotational movement of said first beater; and a second beater and a second foot pedal positioned adjacent said first foot pedal;

a second dual drum pedal including: a third beater, a third foot pedal, and second means connected to said third beater and said third foot pedal for controlling a substantially rotational movement of said third beater; and a fourth beater, a fourth foot pedal and a third means connected to said fourth foot pedal and said second beater for controlling a substantially rotational movement of said second beater;

said first dual drum pedal includes fourth means, connected to said second foot pedal and said fourth beater, for controlling a substantially rotational movement of said fourth beater;

fifth means for remotely coupling said second beater to said third controlling means;

sixth means for remotely coupling said fourth controlling means to said fourth beater; and said sixth means includes a first drive belt to operatively connect to said fourth controlling means.

2. A quad bass drum pedal as recited in claim 1, wherein:

said sixth means includes a second drive belt to operatively connect to said fourth beater.

3. A quad bass drum pedal as recited in claim 2, including:

said fourth controlling means includes a first axle, means connected to said second pedal and to said first axle for rotating said first axle about its longitudinal axis, and a first gear attached to said first axle and having at least one tooth;

said first drive belt includes at least one tooth located on an inner surface thereof for engagement with said first gear;

a second axle connected to said fourth beater and adapted for rotating said fourth beater about a longitudinal axis thereof;

a second gear having at least one tooth attached to said second axle; and said second drive belt includes at least one tooth located laterally on an inner surface thereof for engagement with said second gear.

4. A quad bass drum pedal as recited in claim 3, wherein:

said sixth means includes at least one elongated drive shaft, and third and fourth gears attached to either end of said at least one elongated drive shaft for engagement with said first and second drive belts, respectively.

5. A quad bass drum pedal as recited in claim 4, wherein:

said first and said second dual pedals each include at least one post for supporting said beaters in an elevated position, each said support post having a drive shaft support member extending outwardly therefrom; and said drive shaft support members each includes an aperture laterally disposed for insertion of said at least one drive shaft therethrough, and a plurality of ball beatings positioned within said apertures so as to operatively engage with said at least one drive shaft.

6. A quad bass drum pedal as recited in claim 1, including:

a first base plate;

said first foot pedal and said second foot pedal are disposed adjacent each other and pivotally connect to said first base plate each at a heel portion thereof;

said first base plate includes a first heel support connected to said first base plate at an elevated position relative thereto;

a second base plate;

said third foot pedal and said fourth foot pedal are disposed adjacent each other and pivotally connect to said second base plate each at a heel portion thereof; and said second base plate includes a second heel support connected to said second base plate at an elevated position relative thereto.

7. A quad bass drum pedal as recited in claim 6, wherein:

said first and said second heel supports are adjustably elevated relative to said first and second base plates, respectively.

8. A quad bass drum pedal as recited in claim 6, wherein:

said first and said second heel supports each includes a first member having a first surface area, an elongated member outwardly extending from an underside of said first surface area, a tubular section extending upwardly from said base plate for telescopically receiving said elongated member, and means for selectively locking said elongated member in a fixed position within said tubular section.

9. A foot pedal device for a bass drum, comprising:

a foot pedal;

a beater;

means, connected to said beater and pivotably connected to said foot pedal, for substantially rotationally bringing said beater into and out of contact with said drum;

means for adjustably supporting a heel portion of a foot in an elevated position relative to a ground surface;

said heel support means includes a first member having a first surface area, an elongated second member attached to a second surface area of said first member and extending outwardly therefrom, and an elongated third member which rests on a ground surface and extends upwardly therefrom; and wherein said second member is slidably disposed within said third member.

10. A foot pedal device as recited in claim 9, wherein:

said heel support means includes means for locking said second member in a fixed position substantially within said third member.

11. A foot pedal device as recited in claim 10, wherein:

said elongated third member includes a base portion which is adapted to rest on a ground surface, and a plurality of apertures disposed substantially along said base portion; and said locking means includes a fourth member pivotally attached to said second member at one end and having an aperture defined laterally therethrough at a second end thereof, and a fifth member for insertion through said aperture of said fourth member and into one of said apertures of said base portion of said third member.

12. A foot pedal device as recited in claim 10, wherein:

said third member includes an aperture laterally disposed on a side thereof, having a threaded opening; and said locking means includes a bolt having a head adapted for manual tightening thereof within said aperture.

13. A foot pedal device as recited in claim 9, wherein:

said heel support means includes said first member having said first surface area shaped substantially to a contour of an underside of a heel portion of a foot.

14. A foot pedal device as recited in claim 9, wherein:

said heel support means includes said first member having said first surface area substantially shaped to a contour of an arch portion of a foot.

15. A quad drum pedal device, comprising:

a first mallet;

a first foot operating means, operatively connected to said first mallet, for controlling a substantially rotational movement of said first mallet;

a second mallet adjacent said first mallet;

a second foot operating means, operatively connected to said second mallet, for controlling a substantially rotational movement of said second mallet remotely;

a third mallet;

a third foot operating means, operatively connected to said third mallet and adjacent said second foot operating means, for controlling a substantially rotational movement of said third mallet;

a fourth mallet adjacent said third mallet; and a fourth foot operating means, operatively connected to said fourth mallet and adjacent said first foot operating means, for controlling a substantially rotational movement of said fourth mallet remotely.

16. A device as recited in claim 15, further including:

fifth means, adjacent said first and said fourth foot operating means, for supporting a heel portion of a foot in an elevated position; and sixth means, adjacent said second and said third foot operating means, for supporting a heel portion of a foot in an elevated position; and wherein said fifth and said sixth means provide adjustably elevated support relative to said foot operating means.

17. A device as recited in claim 16, wherein:

said fifth and said sixth means each comprises a first support member having a first flat surface area, a second support member attached to a second surface of said first support member so as to extend outwardly therefrom, a third support member having an elongated tubular section and adapted to telescopically receive said second support member, and means connected to said third support member for selectively locking said second support member in a fixed position substantially within said third support member.

18. A device as recited in claim 15, wherein:

said second foot operating means includes a foot pedal, a first axle connected to said second foot pedal and adapted to rotate upon movement of said second foot pedal, at least one elongated drive shaft, a first drive belt coupling a first end of said at least one drive shaft to said first axle, a second axle connected to said second mallet to allow said second mallet to rotate thereabout, and a second drive belt coupling a second end of said at least one drive shaft to said second axle.

19. A device as recited in claim 18, including:

a first drive shaft adapted to engage at a first end with said first drive belt;

a second drive shaft;

a first universal joint adapted to operatively couple a second end of said first drive shaft and a first end of said second drive shaft;

a third drive shaft adapted to engage at a first end with said second drive belt; and a second universal joint adapted to operatively couple a second end of said second drive shaft with a second end of said third drive shaft.

20. A device as recited in claim 18, further including:

a first post member for supporting said first mallet and said second mallet in an elevated position;

a second post member for supporting said third mallet and said fourth mallet in an elevated position; and wherein said first post member and said second post member support said at least one elongated drive shaft in position.

21. A device as recited in claim 20, further including:

ball bearings disposed between said elongated drive shaft and said first and said second post members.

22. A device as recited in claim 15, wherein:

said second foot operating means and said fourth foot operating means include means for selectively adjusting a position of said first mallet and said second mallet relative to said third mallet and said fourth mallet.

23. A pedal as recited in claim 1, further including:

means for adjusting a position of said first dual drum pedal relative to said second dual drum pedal.

* * * * *